US007057343B2

(12) United States Patent
Fujitani

(10) Patent No.: US 7,057,343 B2
(45) Date of Patent: Jun. 6, 2006

(54) PLASMA DISPLAY PANEL

(75) Inventor: Morio Fujitani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 121 days.

(21) Appl. No.: 10/487,715

(22) PCT Filed: Jul. 3, 2003

(86) PCT No.: PCT/JP03/08466

§ 371 (c)(1),
(2), (4) Date: Feb. 26, 2004

(87) PCT Pub. No.: WO2004/006279

PCT Pub. Date: Jan. 15, 2004

(65) Prior Publication Data

US 2004/0245928 A1 Dec. 9, 2004

(30) Foreign Application Priority Data

Jul. 4, 2002 (JP) ..... 2002-195500
Jul. 12, 2002 (JP) ..... 2002-203834

(51) Int. Cl.
*H01J 17/49* (2006.01)

(52) U.S. Cl. ..... 313/586; 313/582; 313/587

(58) Field of Classification Search ..... 313/582–587; 345/74.1–76, 55, 60; 315/169.3, 169.4
See application file for complete search history.

(56) References Cited

U.S. PATENT DOCUMENTS 5,736,815 A * 4/1998 Amemiya ..... 313/586
6,333,599 B1 * 12/2001 Kawanami et al. ..... 313/582
6,433,477 B1 * 8/2002 Ha et al. ..... 313/586
6,525,470 B1 * 2/2003 Amemiya ..... 313/586
6,611,099 B1 * 8/2003 Murata et al. ..... 313/582
RE38,357 E * 12/2003 Amemiya et al. ..... 313/582
6,812,641 B1 * 11/2004 Fujitani et al. ..... 313/587
2001/0015623 A1 * 8/2001 Takada et al. ..... 313/586
2001/0015628 A1 8/2001 Tokunaga et al. ..... 315/169.3

FOREIGN PATENT DOCUMENTS

JP 9-265913 10/1997

(Continued)

OTHER PUBLICATIONS

Hiraki Uchiike et al., "All about plasma display", (May 1, 1997), Industrial Research Committee, pp. 79, 80.

*Primary Examiner*—Edward J. Glick
*Assistant Examiner*—Elizabeth Keaney
(74) *Attorney, Agent, or Firm*—Wenderoth, Lind & Ponack, L.L.P.

(57) ABSTRACT

A plasma display panel is provided, in which a false discharge between adjacent discharge cells is prevented, and generation of an address discharge between a scanning electrode and a data electrode is ensured, thereby enabling the panel to display a quality picture. A discharge cell includes a recess in a dielectric layer that overlaps a display electrode consisting of a scanning electrode and a sustain electrode, wherein a dimension where the recess overlaps the scanning electrode is made larger than a dimension where the recess overlaps the sustain electrode. A discharge area is restricted within the recess for preventing a false discharge to occur between adjacent discharge cells, thereby stabilizing address discharge between the scanning electrode and a data electrode.

22 Claims, 20 Drawing Sheets

FOREIGN PATENT DOCUMENTS

| | | |
|---|---|---|
| JP | 10-92326 | 4/1998 |
| JP | 11/212515 | 8/1999 |
| JP | 12-156168 | 6/2000 |
| JP | 2000-285811 | 10/2000 |
| JP | 2001-118520 | 4/2001 |
| JP | 2001-160361 | 6/2001 |
| JP | 2003-234069 | 8/2003 |
| KR | 2001-62222 | 7/2001 |

* cited by examiner

PLASMA DISPLAY PANEL

TECHNICAL FIELD

This invention relates to a plasma display panel known as a display device.

BACKGROUND ART

A plasma display panel (hereinafter called PDP) displays a picture with a gas discharge causing ultraviolet rays and exciting a phosphor with the ultraviolet rays.

The PDP can be roughly classified into an AC type and a DC type for its driving method, and a surface discharge type and an opposing discharge type for its discharging scheme. At present, a surface discharge type with three electrodes makes a mainstream of the PDP because of its convenience for producing high-precision and a large screen, and because of its simplicity in manufacturing. This type comprises: a front panel and a back panel oppositely faced, with the front panel having a plurality of display electrodes composed of a scanning electrode and a sustain electrode, and the back panel having a plurality of data electrodes intersecting the display electrodes at right angles; a discharge cell formed at an intersection of a display electrode and a data electrode; and a phosphor layer deposited in the discharge cell. With this construction, the phosphor layer can be made relatively thicker fitting to a color display which employs a phosphor. This condition is disclosed in a non-patent related document, 'All about plasma display' (May 1, 1997), coauthored by Hiraki Uchiike and Shigeo Mikoshiba, Industrial Research Committee, p.p. 79, 80).

A plasma display device using the above mentioned PDP features a high displaying speed, a wide viewing angle, easy production in a large size and a higher display quality by its self-luminescence, as compared to a liquid crystal panel. Because of its features, the device is particularly receiving attention among flat panel devices and is used for a variety of applications such as a display device for a public place and a display device for a family enjoying a picture on a large screen.

Meanwhile, a request for a high precision PDP of this type is growing. In order to meet the request, an arrayed pitch of discharge cells must be narrow. When the pitch is narrowed, a problem occurs in that resulting is a false discharge between adjacent discharge cells, thereby adversely affecting picture display. To display a quality picture with no defect such as of no-lighting, it is necessary to securely generate an address discharge between the scanning electrode and the data electrode when the address discharge is made for displaying a picture.

The present invention is made to overcome above problems and aims to provide a PDP, by preventing a false discharge between adjacent discharge cells even for a high-precision PDP and securely generating an address discharge between a scanning electrode and a data electrode.

SUMMARY OF THE INVENTION

A PDP in this invention includes a front panel having a plurality of display electrodes composed of a scanning electrode and a sustain electrode covered with a dielectric layer, and a back panel having a plurality of data electrodes intersecting the display electrodes at right angles. The panels face each other so that a discharge space is created between them, forming a discharge cell at an intersection between each display electrode and data electrode. In the discharge cell, the dielectric layer includes a recess overlapping the display electrode, with a dimension where the recess overlaps the scanning electrode being larger than a dimension where the recess overlaps the sustain electrode.

With this structure, discharge is restricted within the recess and a false discharge to an adjacent cell is prevented, and an address discharge between the scanning electrode and the data electrode is secured, thereby attaining a PDP with a high display quality.

BRIEF DESCRIPTIONS OF THE DRAWINGS

DETAILED DESCRIPTION OF PREFERRED EMBODIMENTS

A plasma display panel in accordance with the present invention is described hereinafter using drawings.

Figure 1:
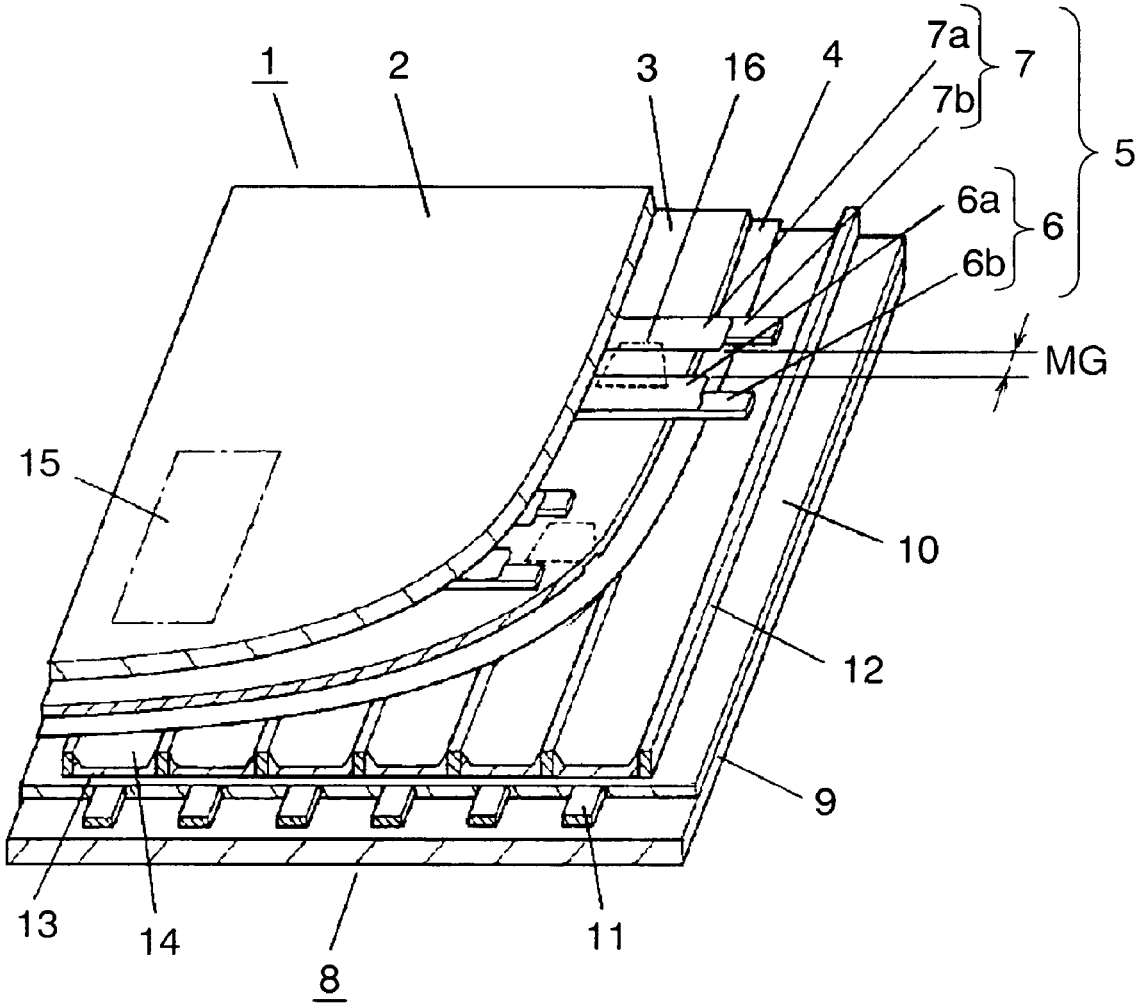
FIG. 1 is a cross-sectional perspective view of a PDP of the present invention briefly showing a structure of the PDP.

FIG. 1 is a cross-sectional perspective view of a PDP of the invention briefly showing a structure of the PDP. Front panel 1 includes a plurality of display electrodes 5 covered with dielectric layer 3 and protective film 4 of evaporated MgO, formed on substrate 2 made of a glass-like transparent and insulating material. Display electrode 5 is composed of scanning electrode 6 and sustain electrode 7 in a pair, with scanning electrode 6 and sustain electrode 7 facing each other separated by a discharge gap MG. Scanning electrode 6 is composed of transparent electrode 6*a* and of non-transparent bus electrode 6*b* made of metallic materials such as Cr/Cu/Cr, and Ag formed on the transparent electrode 6*a*. Likewise, sustain electrode 7 is composed of transparent electrode 7*a* and of non-transparent bus electrode 7*b* of metallic materials such as Cr, Cu and Ag formed on the transparent electrode 7*a*.

Back panel 8 includes a plurality of data electrodes 11 covered with dielectric layer 10, formed on substrate 9 of a glass-like insulating material. Between electrodes 11 on dielectric layer 10, barrier rib 12 in a stripe shape is interposed in parallel with data electrodes 11. On dielectric layer 10 and on a side of barrier rib 12, phosphor layer 13 is deposited in a stripe shape. Front panel 1 and back panel 8 are placed facing each other with a discharge space 14 therebetween, and scanning electrode 6 and sustain electrode 7 intersect data electrode 11 at right angles. In discharge space 14, at least one of rare gases including helium, neon, argon and xenon is enclosed as a discharge gas. Discharge space 14, formed at an intersection where data electrode 11 bordered by barrier ribs 12 crosses scanning electrode 6 and sustain electrode 7, acts as discharge cell 15.

First Exemplary Embodiment

Figure 2A:
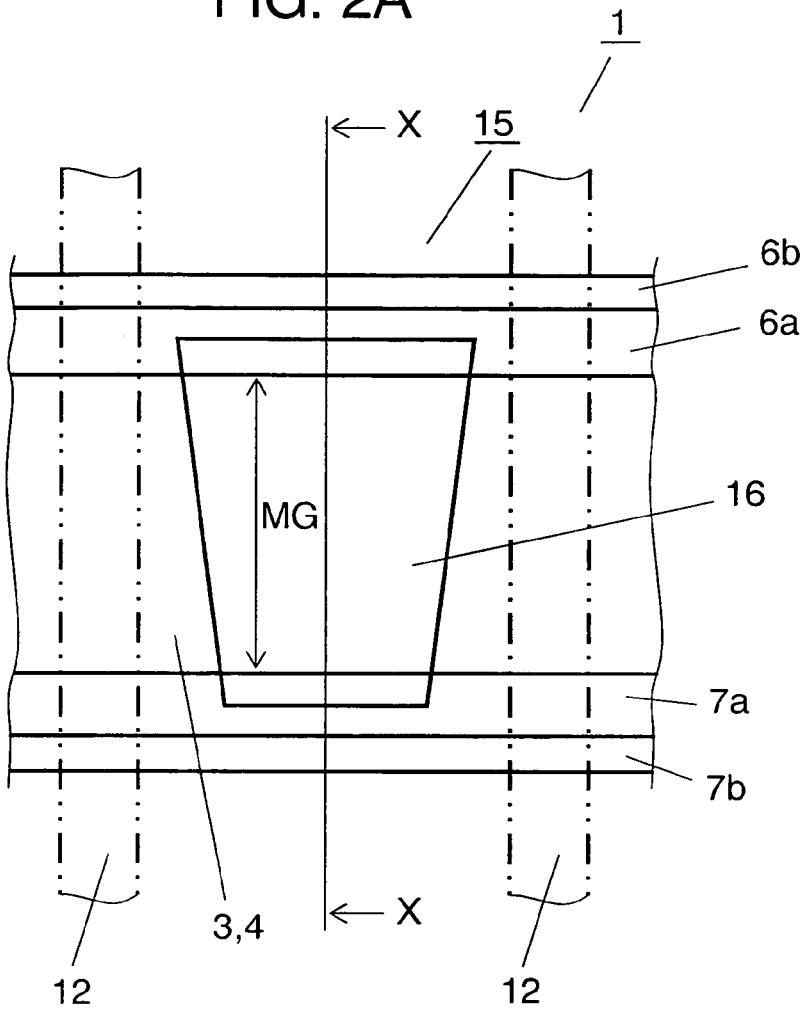
FIGS. 2A and 2B are partially magnified views of a discharge cell of a front panel of the PDP in accordance with a first exemplary embodiment of the present invention.
Figure 2B:
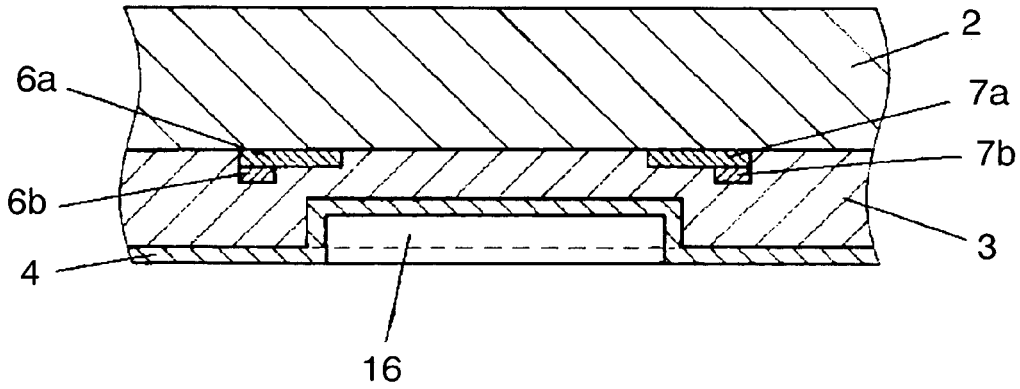
Figure 3A:
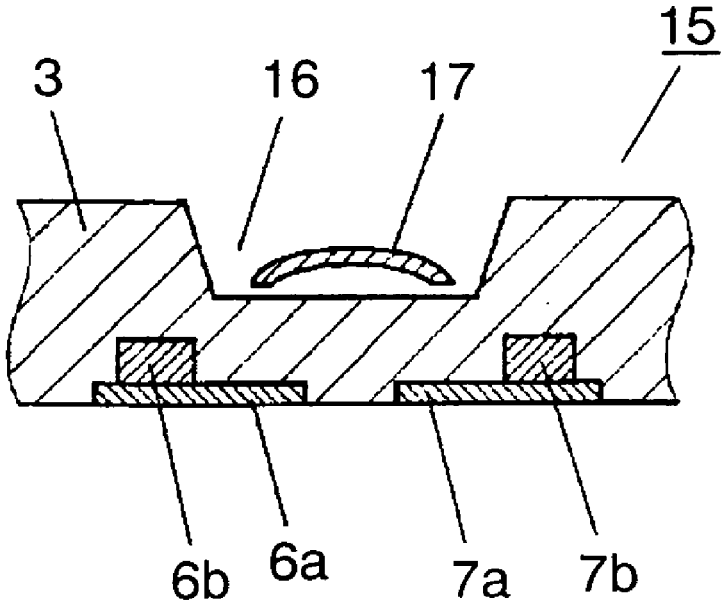
FIGS. 3A and 3B are cross sectional views of the front panel in accordance with the first exemplary embodiment of the present invention depicting a discharge status.
Figure 3B:
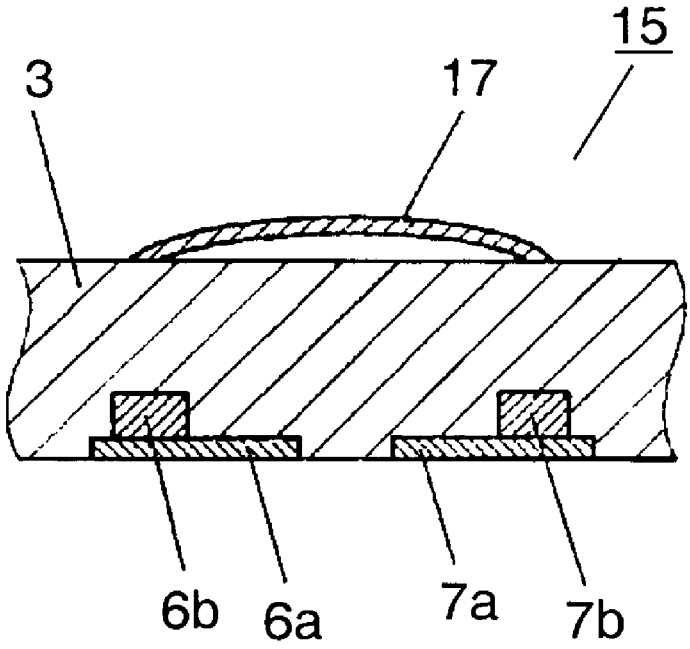

FIGS. 2A and 2B are partially magnified views of a discharge cell of a front panel of the PDP according to exemplary embodiment 1 of the present invention, wherein FIG. 2A is a plan view of the PDP viewed from a side of a discharge cell, and FIG. 2B is a cross sectional view taken along line X—X marked with an arrow. FIGS. 3A and 3B are cross sectional views of the front panel according to exemplary embodiment 1 of the invention depicting a discharge status.

As shown in FIGS. 2A and 2B, in each discharge cell 15, dielectric layer 3 partially overlaps scanning electrode 6 and sustain electrode 7 forming display electrode 5, and includes recess 16 concaved toward substrate 2.

In exemplary embodiment 1, recess 16 is wide in its shape where the recess overlaps scanning electrode 6, and a dimension where recess 16 overlaps the scanning electrode 6 is made larger than a dimension where recess 16 overlaps sustain electrode 7. A position where barrier rib 12 contacts front panel 1 is shown by two dots chain lines.

As shown in FIGS. 2A and 2B, in discharge cell 15, thickness in dielectric layer 3 is different between an area having recess 16 and a remaining area, with a different electrostatic capacity as a condenser and a different discharge voltage. Because recess 16 having a thinner dielectric layer 3 has a larger electrostatic capacity easily storing an electric charge at its bottom, a discharge voltage is lower and a discharge is readily generated and maintained. Whereas, in the area other than recess 16, the electrostatic capacity is smaller storing less electric charge, so that a higher discharge voltage, generation, and maintenance of a discharge, are restrained.

Namely, as shown in FIG. 3A, when recess 16 according to exemplary embodiment 1 exists in discharge cell 15, discharge 17 is restricted within recess 16 in discharge cell 15. Whereas, as shown in FIG. 3B, when this recess does not exist, a discharge area expands as is shown by discharge 18 causing an abnormal discharge leaking out to adjacent discharge cell 15. The abnormal discharge can thus be controlled in exemplary embodiment 1.

Moreover, in exemplary embodiment 1, because a dimension where recess 16 overlaps scanning electrode 6 is made larger than a dimension where recess 16 overlaps sustain electrode 7, an address discharge which is made for displaying a picture in the PDP is reliably generated between scanning electrode 6 and data electrode 11, thereby improving quality of picture display.

Additionally, because a discharge area is restricted within recess 16 as mentioned, and recess 16 is formed inside barrier ribs 12 as shown in FIG. 2A, generation of a discharge near barrier rib 12 is prevented. As a result, a problem—barrier rib 12 is electrically charged by the discharge and is etched with its ion-impact, and an etched substance of barrier rib 12 falls and piles on phosphor layer 13 deteriorating performance of phosphor layer 13—is prevented.

Furthermore, as shown in FIG. 2A, because a side face of recess 16 is deposited with protective film 4 of MgO, a surface dimension of emitting electrons is increased, thereby enabling increase of an emitted amount of electrons per discharge cell 15.

Figure 4A:
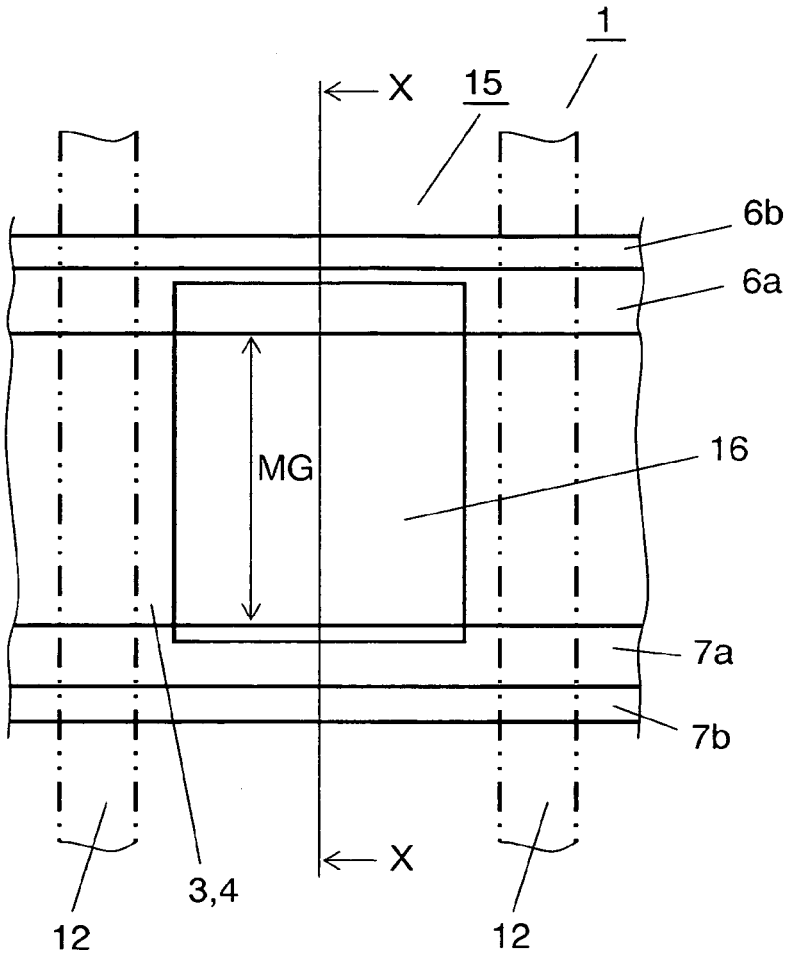
FIGS. 4A and 4B are partially magnified views of a discharge cell having other structure in the front panel of the PDP of the first exemplary embodiment.
Figure 4B:
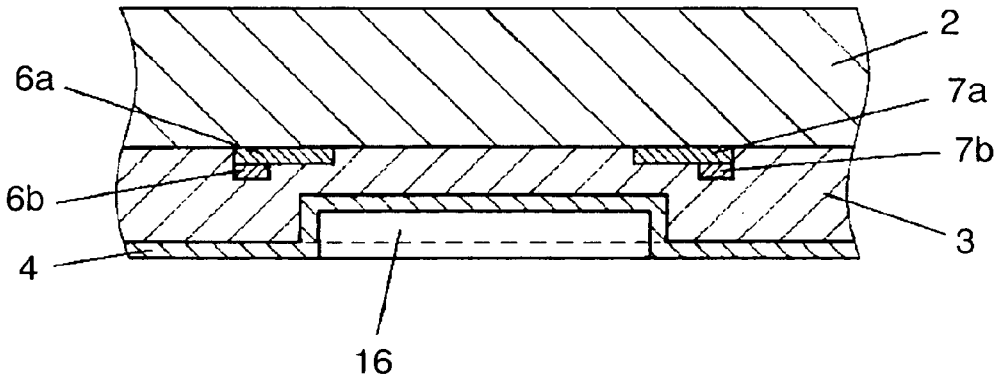
Figure 5A:
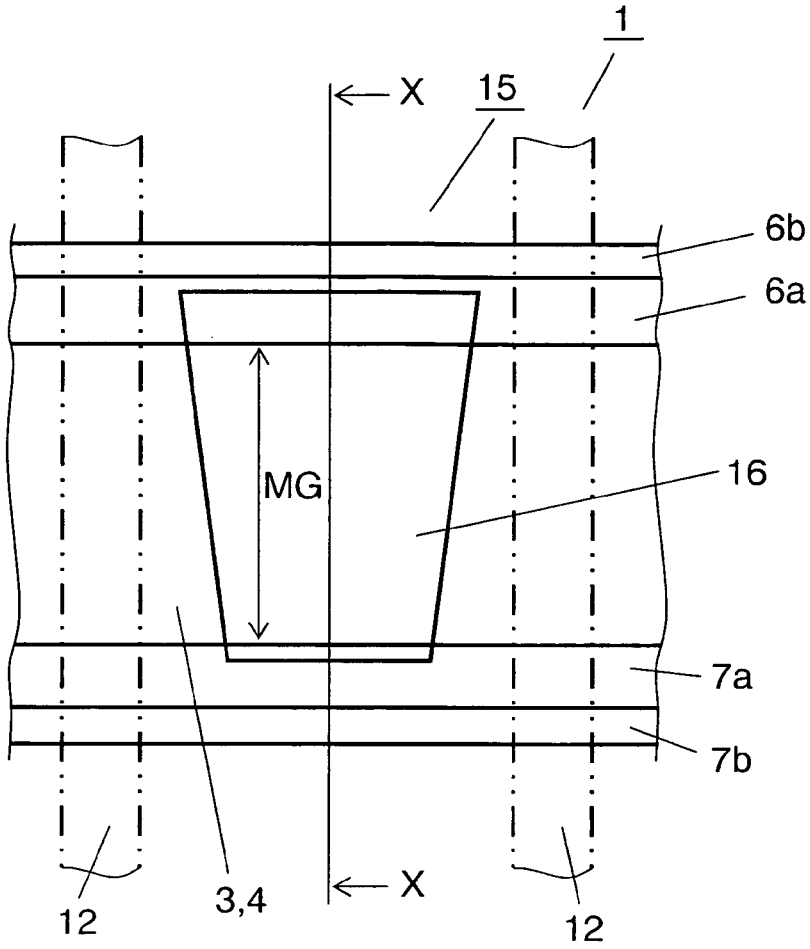
FIGS. 5A and 5B are partially magnified views of a discharge cell having other structure in the front panel of the PDP of the first exemplary embodiment.
Figure 5B:
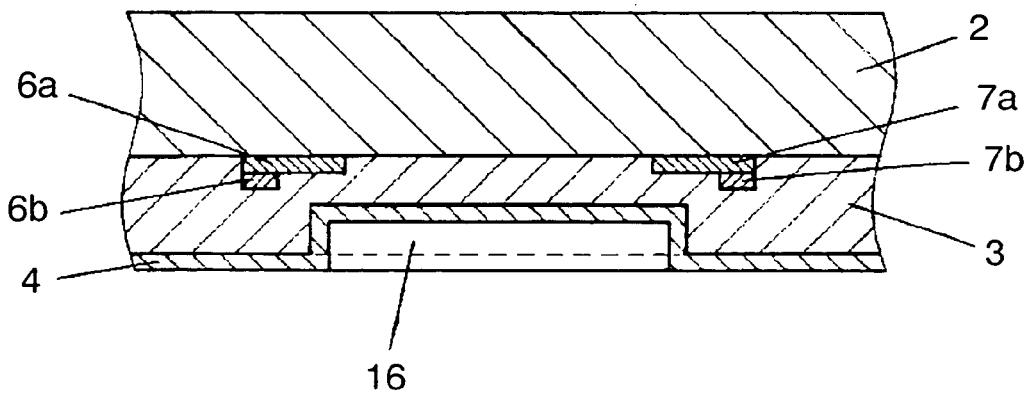
Figure 6A:
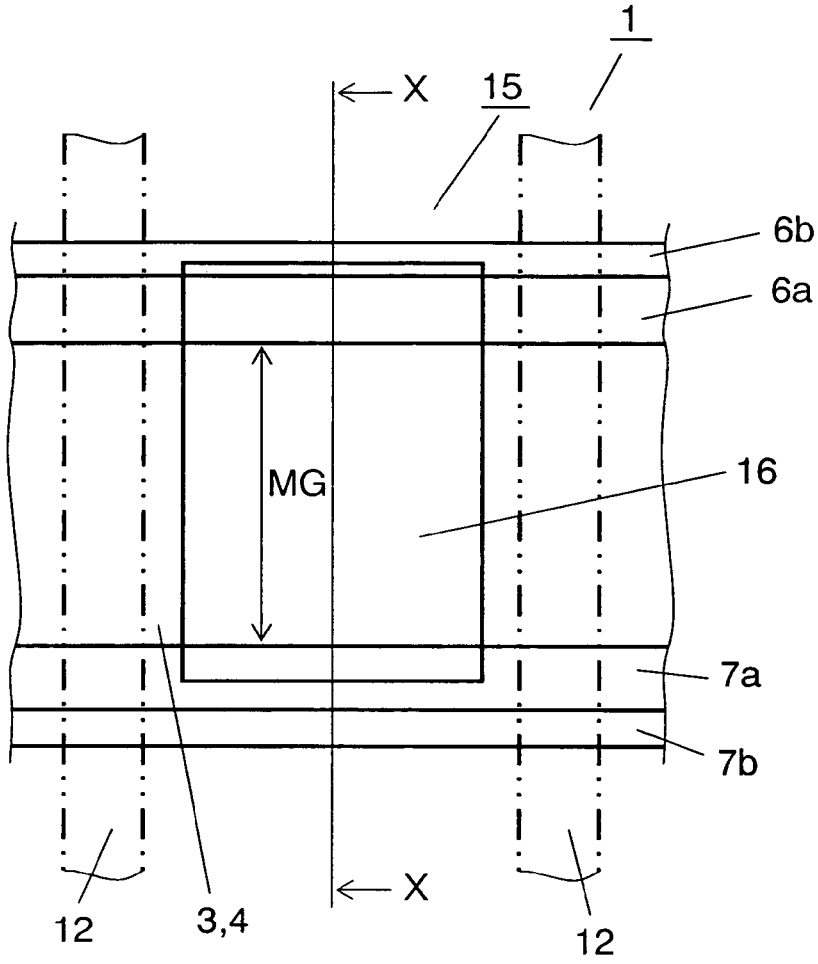
FIGS. 6A and 6B are partially magnified views of a discharge cell having other structure in the front panel of the PDP of the first exemplary embodiment.
Figure 6B:
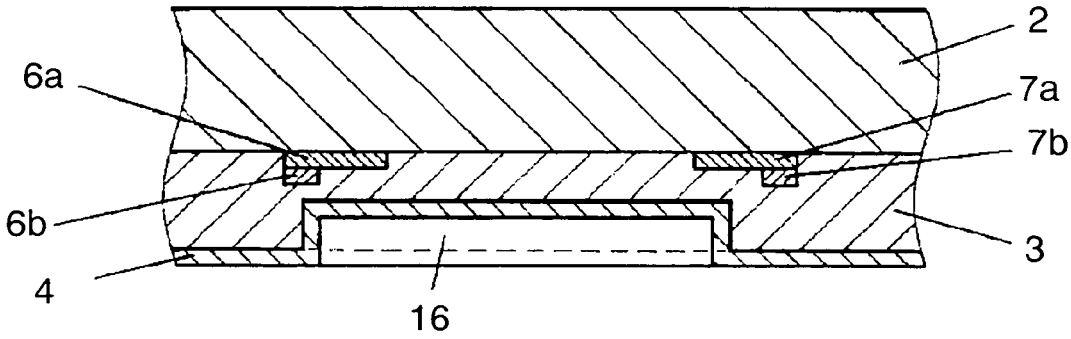
Figure 7A:
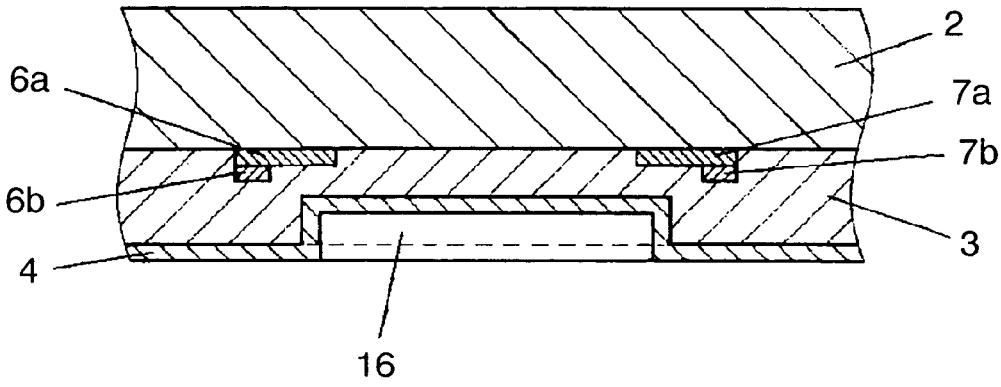
FIGS. 7A and 7B are partially magnified views of a discharge cell of a front panel of the PDP in accordance with a second exemplary embodiment of the present invention.
Figure 7B:
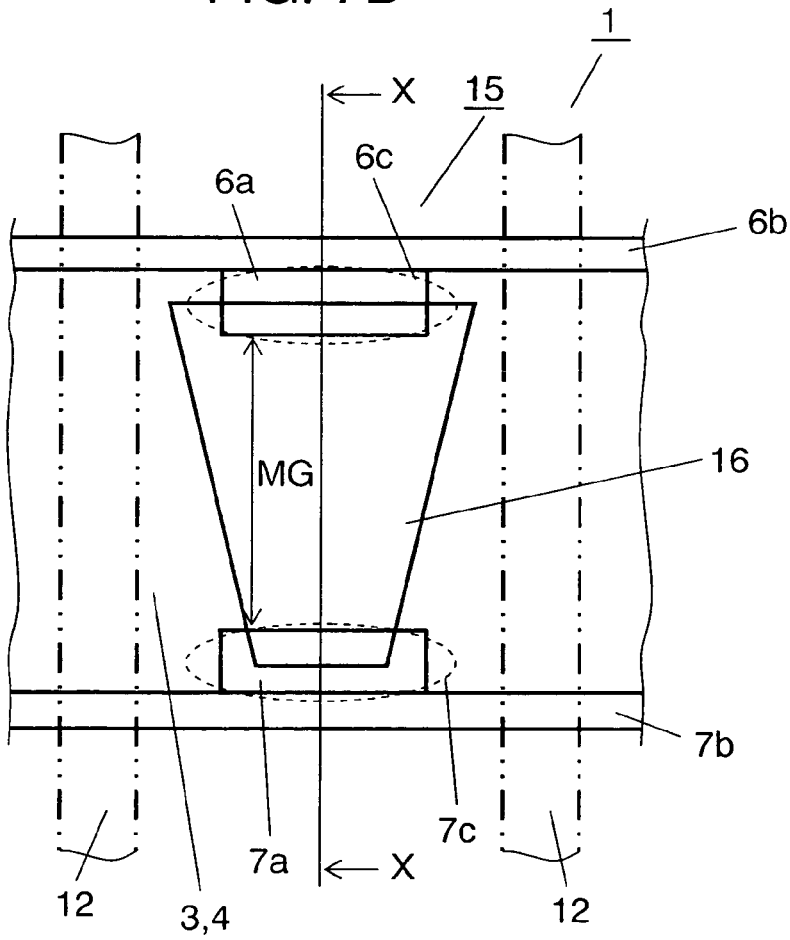
Figure 8A:
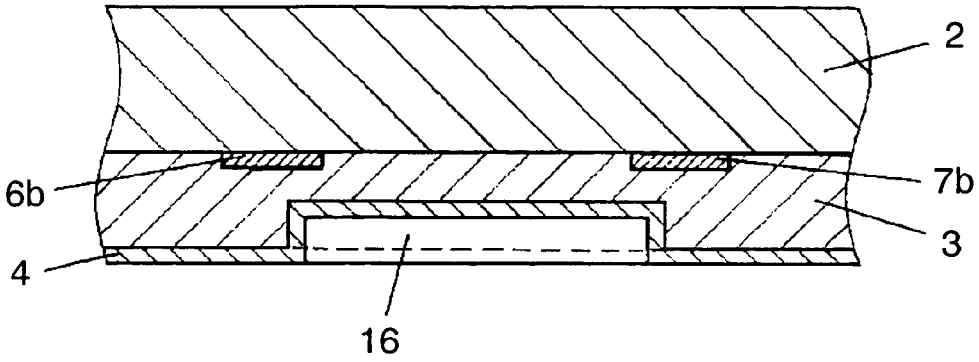
FIGS. 8A and 8B are partially magnified views of a discharge cell having other structure in the front panel of the PDP of the second exemplary embodiment.
Figure 8B:
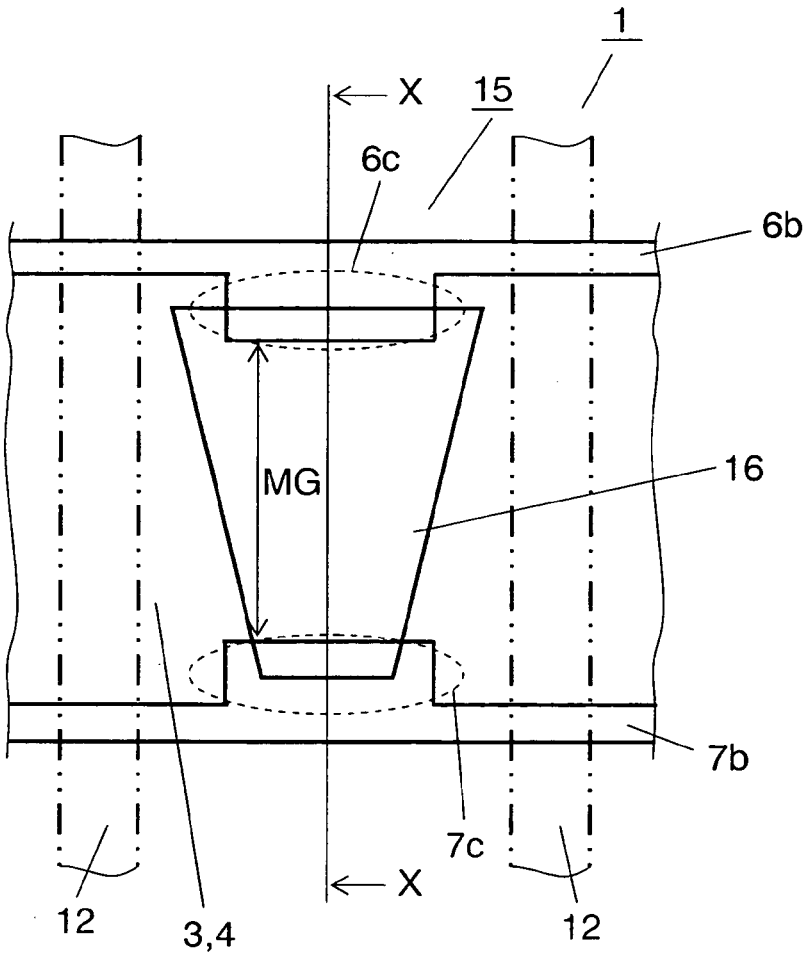
Figure 9A:
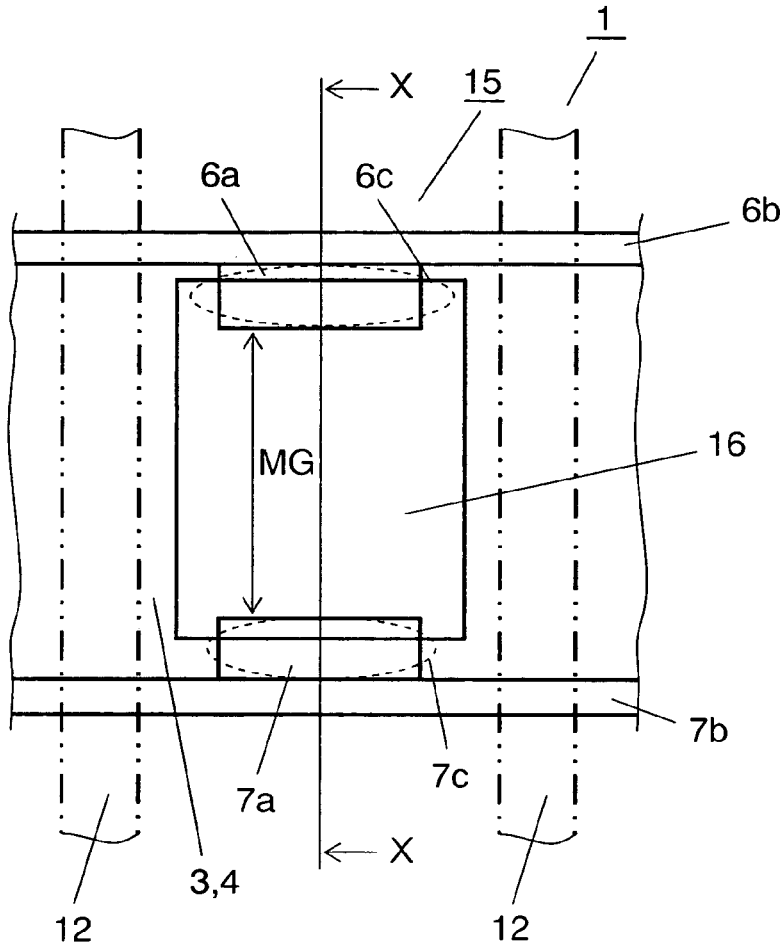
FIGS. 9A and 9B are partially magnified views of a discharge cell having other structure in the front panel of the PDP of the second exemplary embodiment.
Figure 9B:
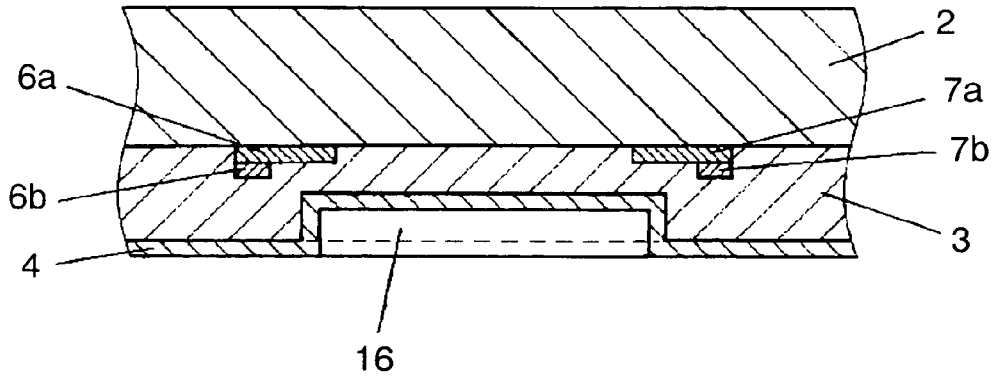
Figure 10A:
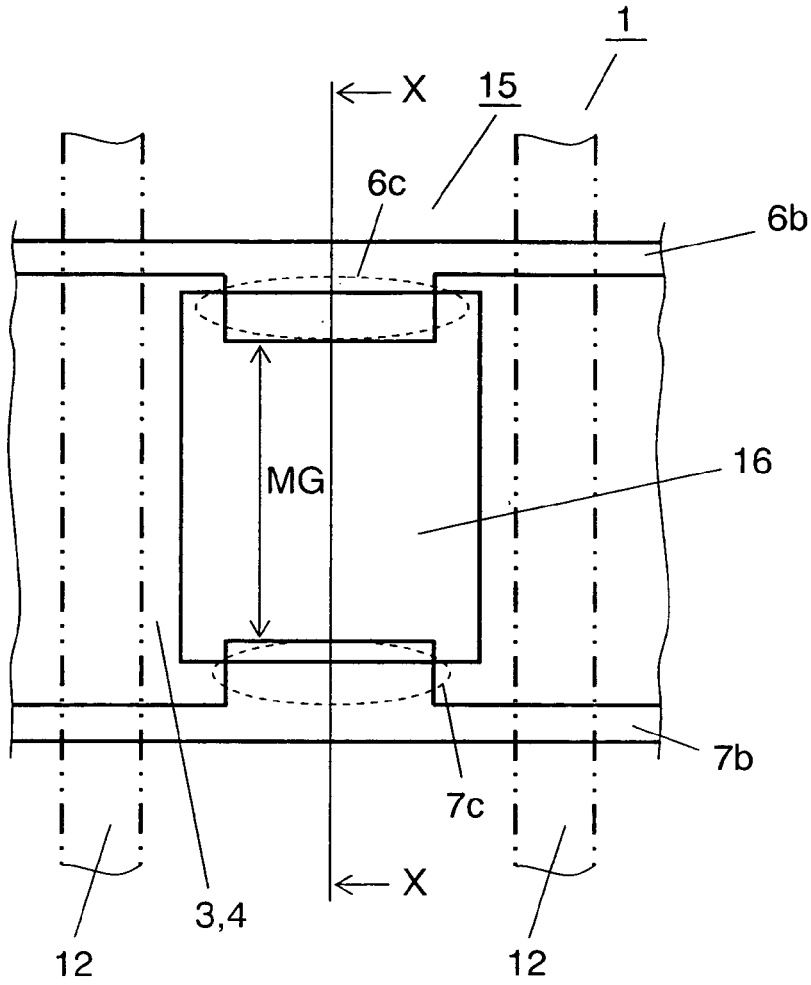
FIGS. 10A and 10B are partially magnified views of a discharge cell having other structure in the front panel of the PDP of the second exemplary embodiment.
Figure 10B:
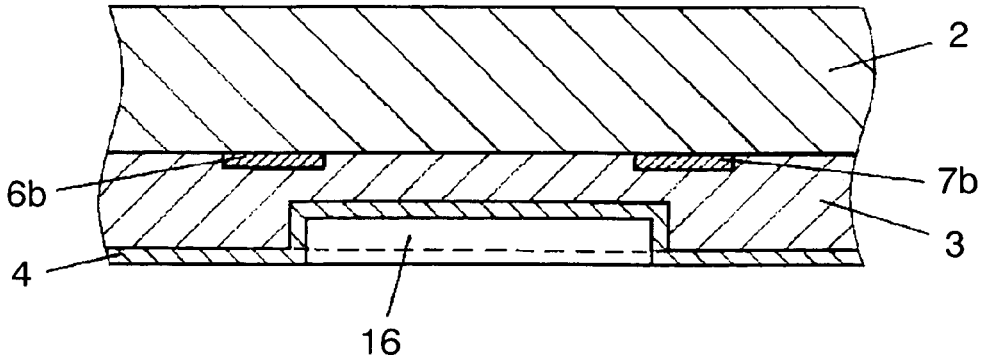

FIGS. 4A–6B are partially magnified views of a discharge cell in the front panel of the PDP in other structures according to exemplary embodiment 1. In the structure shown in FIGS. 4A and 4B, recess 16 in discharge cell 15 is shifted toward scanning electrode 6. In the structure shown in FIGS. 5A and 5B, recess 16 is expanded where a portion overlaps scanning electrode 6 over and above the structure as shown in FIG. 4. It is also possible, as is shown in FIGS. 6A and 6B, to overlap recess 16 with bus electrode 6*b* of scanning electrode 6, and yet to overlap recess 16 only with transparent electrode 7*a* of sustain electrode 7. In this case, because bus electrode 6*b* has better electrical conductivity than does transparent electrode 6*a*, dielectric layer 3 on scanning electrode 6 is very much electrically charged, such that an address discharge securely occurs during an address period. Consequently, a false discharge between adjacent discharge cells 15 is further avoided and picture display quality is further improved. This effect can be further augmented by expanding an opening portion of recess 16 overlapping scanning electrode 6.

Second Exemplary Embodiment

FIGS. 7A to 12B are partially magnified views of a discharge cell of a front panel of a PDP according to exemplary embodiment 2 of the present invention. In discharge cell 15 according to exemplary embodiment 2, protrusions 6*c* and 7*c* are respectively provided for scanning electrode 6 and sustain electrode 7, facing each other and separated by a discharge gap MG. In FIGS. 7A–8B, recess 16 is made so as to overlap opposing protrusions 6*c* and 7*c*, and a portion of recess 16 to overlap scanning electrode 6 is made larger. In FIGS. 9A–10B, a position of recess 16 in discharge cell 15 is shifted toward scanning electrode 6, and a dimension where recess 16 overlaps scanning electrode 6 is made larger than that where the recess overlaps sustain electrode 7. With these structures, because a discharge area in discharge cell 15 is additionally controlled by protrusions 6*c* and 7*c*, an abnormal discharge between adjacent discharge cells 15 and a discharge near barrier rib 12 are very much securely controlled.

In FIGS. 7A, 7B, 9A and 9B, because protrusions 6*c* and 7*c* are composed of transparent electrode 6*a* and 7*a*, luminescence of phosphor layer 13 is effectively permeated. If protrusions 6*c* and 7*c* are composed only of bus electrodes 6*b* and 7*b*, and transparent electrodes 6*a* and 7*a* as shown in FIGS. 8A, 8B, 10A and 10B are eliminated, and formation of display electrode 5 is easy. Additionally, because bus electrodes 6*b* and 7*b* are made of metallic material having better electrical conductivity than that of transparent electrodes 6*a* or 7*a*, an electric charge with respect to recess 16 is easily accumulated, and control of a discharge area in discharge cell 15 is further secured.

Figure 11A:
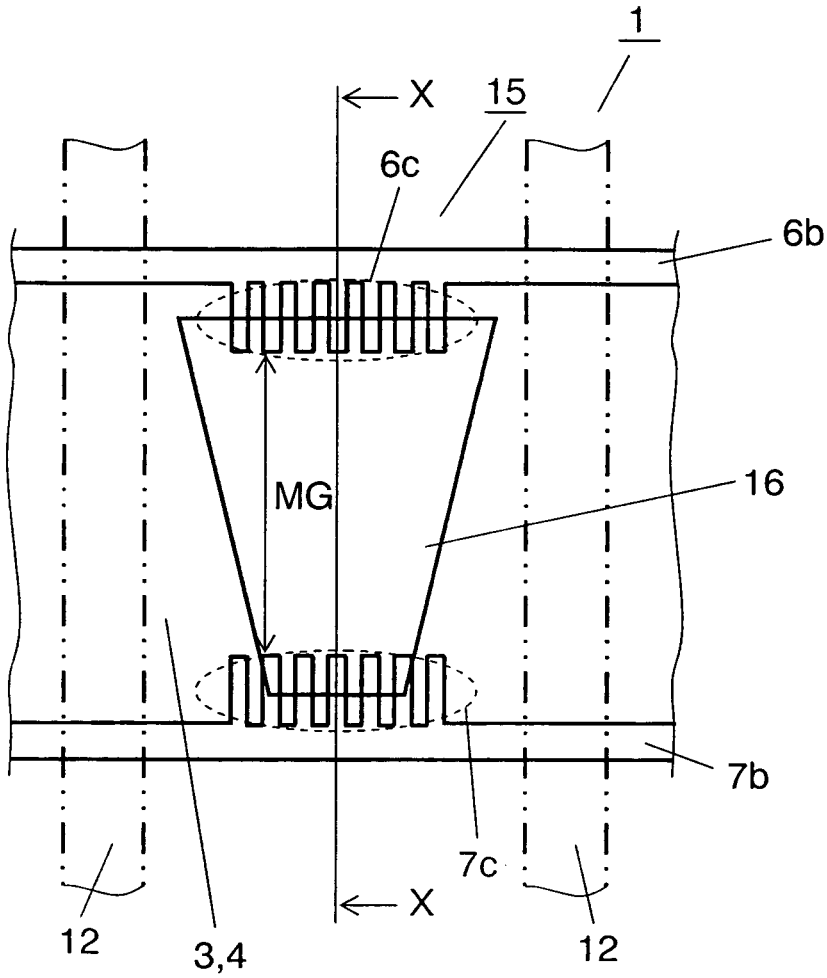
FIGS. 11A and 11B are partially magnified views of a discharge cell having other structure in the front panel of the PDP of the second exemplary embodiment.
Figure 11B:
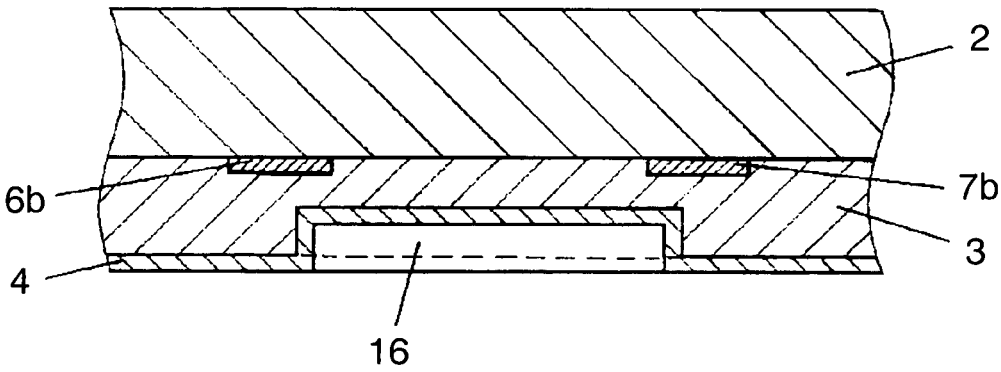
Figure 12A:
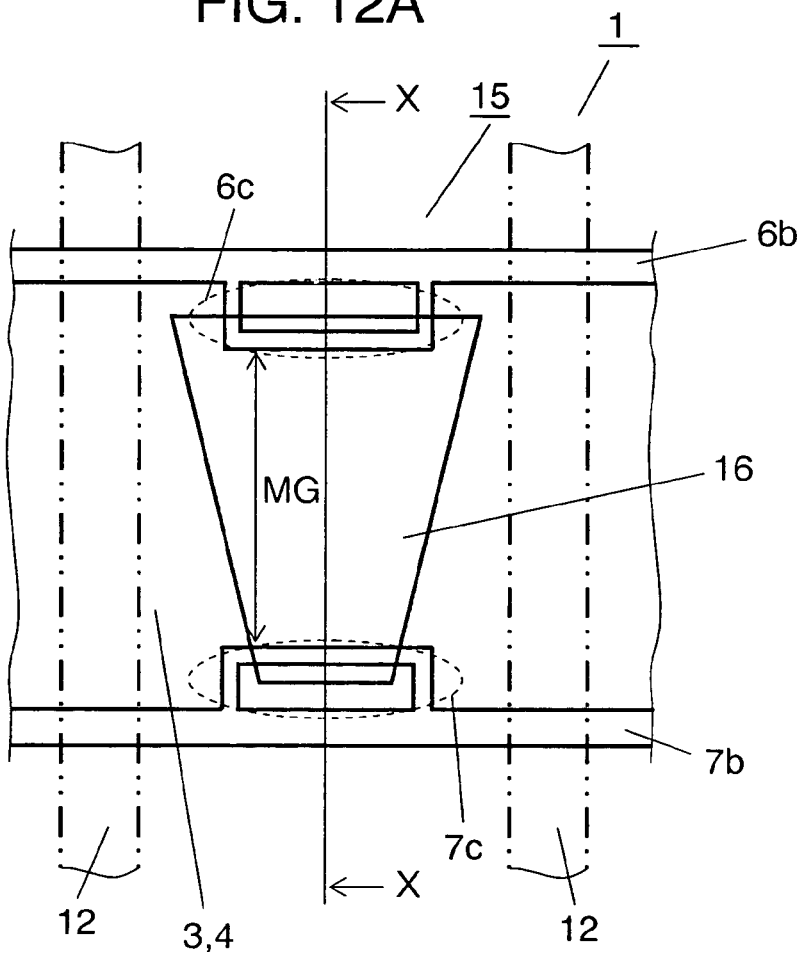
FIGS. 12A and 12B are partially magnified views of a discharge cell having other structure in the front panel of the PDP of the second exemplary embodiment.
Figure 12B:
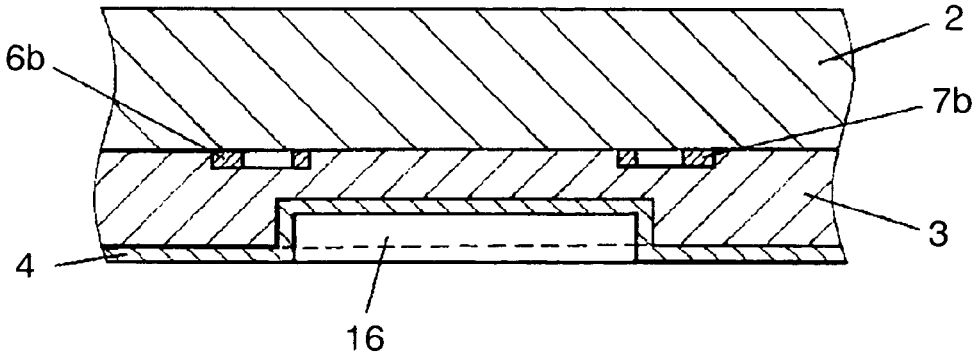

Protrusions 6*c* and 7*c* can be a comb-shape having multiples of forks as illustrated in FIG. 11A, or can be a hollow shape as illustrated in FIG. 12A. With these shapes, a dimension of protrusion 6*c* or of protrusion 7*c* can be reduced without changing a distance of the discharge gap MG. Therefore, even if protrusions 6*c* and 7*c* are composed of non-transparent bus electrode 6*b* and 7*b*, transparency of luminescence from phosphor layer 13 is compensated. If a dimension of the electrodes is reduced, a discharge current can be controlled; therewith power consumption can be reduced.

Third Exemplary Embodiment

FIGS. 13A, 13B and FIGS. 15A to 20B are partially magnified views of a discharge cell of a front panel of the PDP in other structure according to exemplary embodiment 3 of the present invention. FIG. 14 is a cross sectional view of the front panel according to exemplary embodiment 3 of the invention depicting a discharging status.

In discharge cell 15 in exemplary embodiment 3, protrusions 6*c* and 7*c* are respectively provided for scanning electrode 6 and sustain electrode 7 facing each other and separated by a discharge gap MG, and protrusions 6*c* and 7*c* have different dimensions.

Figure 13A:
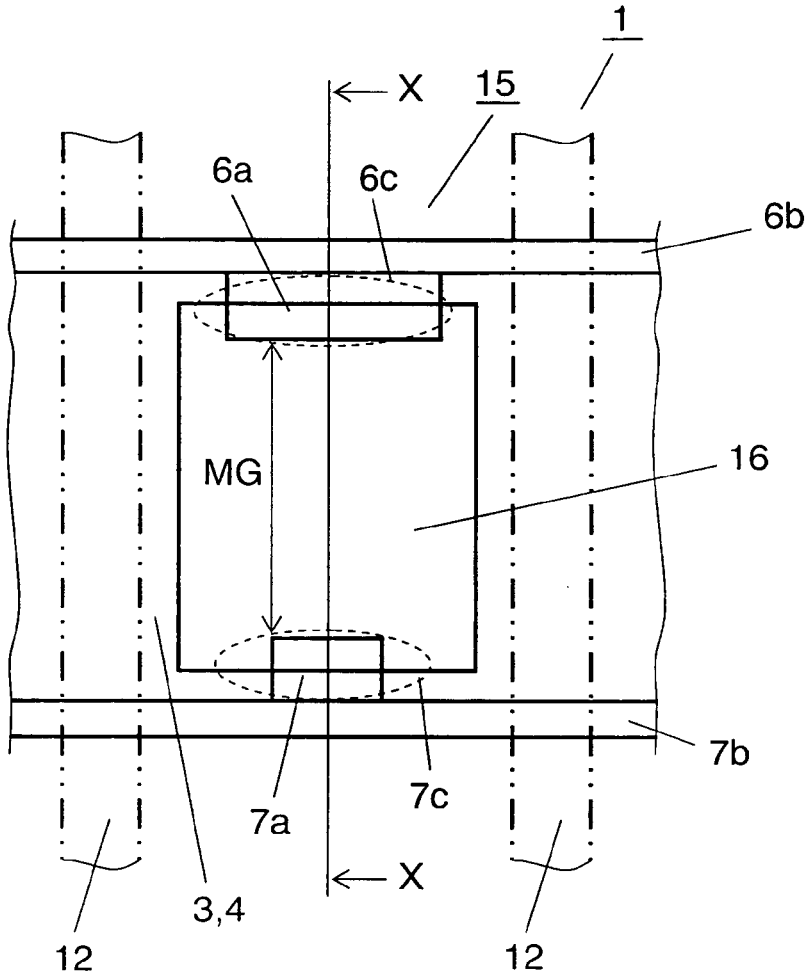
FIGS. 13A and 13B are partially magnified views of a discharge cell in a front panel of the PDP in accordance with a third exemplary embodiment of the present invention.
Figure 13B:
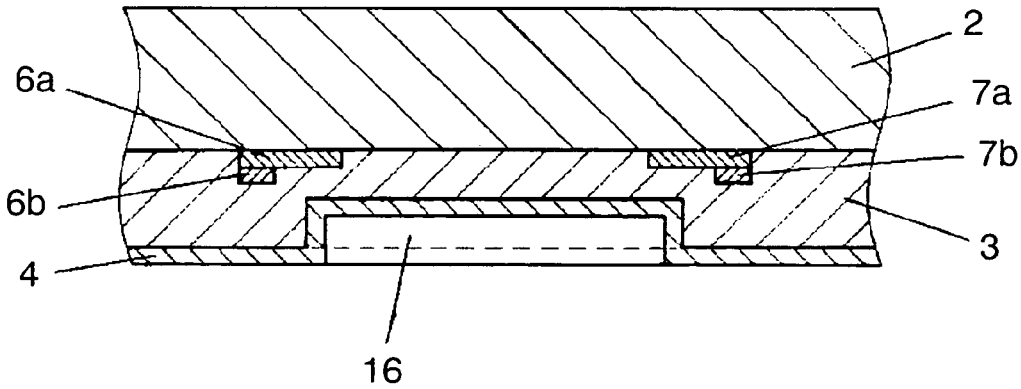
Figure 14:
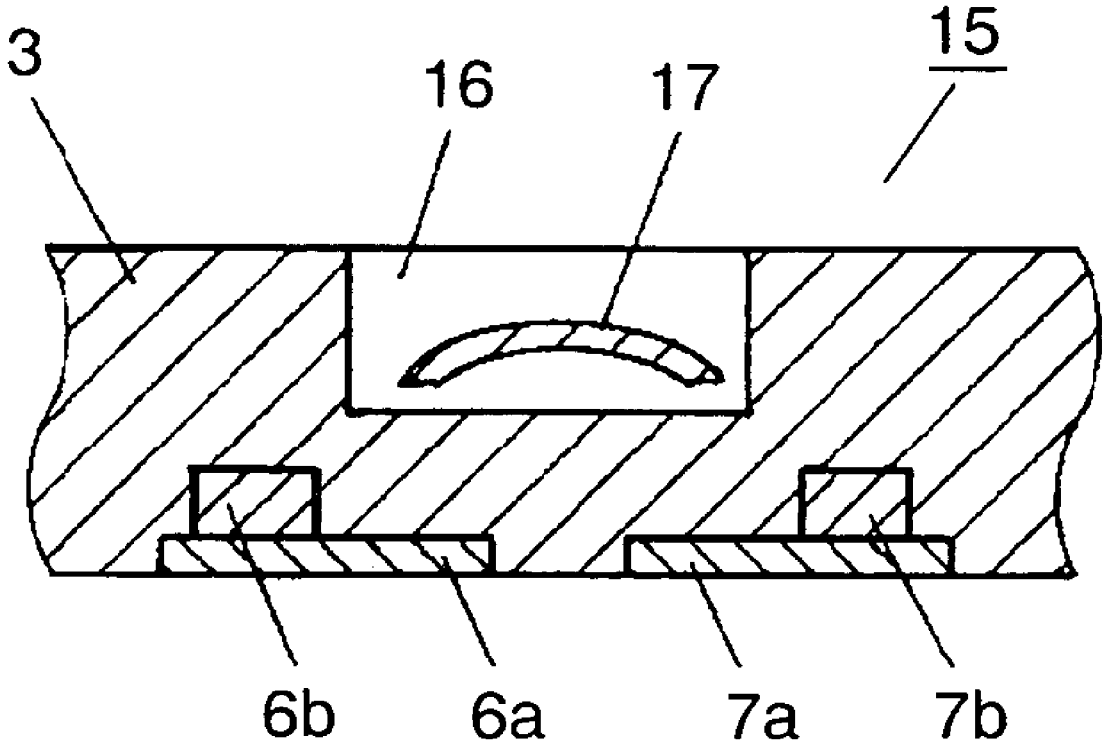
FIG. 14 is a cross sectional view of the front panel in accordance with the third exemplary embodiment of the invention depicting a discharge status.

In discharge cell 15 in FIG. 13A, scanning electrode 6 and sustain electrode 7 respectively includes protrusion 6*c* and protrusion 7*c* facing each other separated by the discharge gap MG. Recess 16 is constituted so as to overlap protrusions 6*c* and 7*c*, and a dimension of protrusion 6*c* is made larger than that of protrusion 7*c*. Because of this structure, a dimension where recess 16 overlaps scanning electrode 6 is larger than a dimension where recess 16 overlaps sustain electrode 7. Therefore, as shown in FIG. 14, generation and continuation of discharge 17 is restricted within a area of recess 16. An abnormal discharge between adjacent discharge cells 15 is thus prevented to occur even when a high precision PDP is produced. Herein, FIG. 14 is a cross sectional view of FIG. 13A taken along line of X—X marked with an arrow, but protective film 4 is eliminated from being detailed.

Additionally, by making a dimension of protrusion 6*c* larger than that of protrusion 7*c*, a dimension where recess 16 and scanning electrode 6 overlap is made larger than a dimension where recess 16 and sustain electrode 7 overlap. Because of this, an address discharge which is produced between scanning electrode 6 and data electrode 11 for displaying a picture is secured, thereby improving quality of a displayed picture.

Figure 15A:
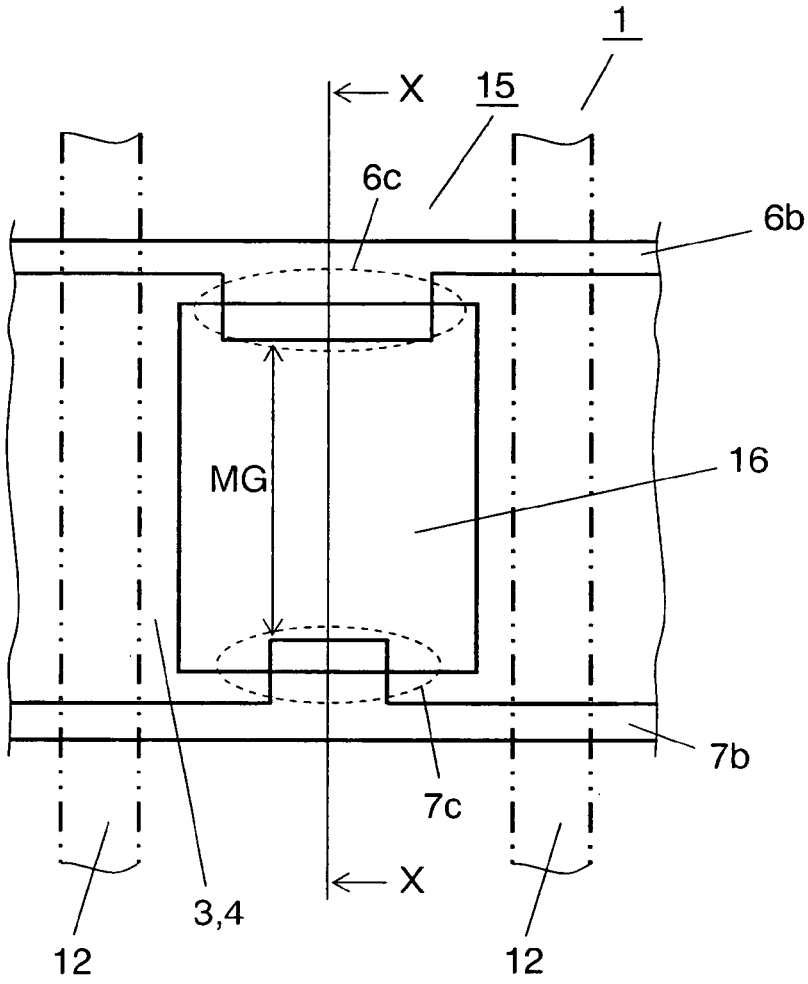
FIGS. 15A and 15B are partially magnified views of a discharge cell having other structure in the front panel of the PDP in accordance with the third exemplary embodiment of the invention.
Figure 15B:
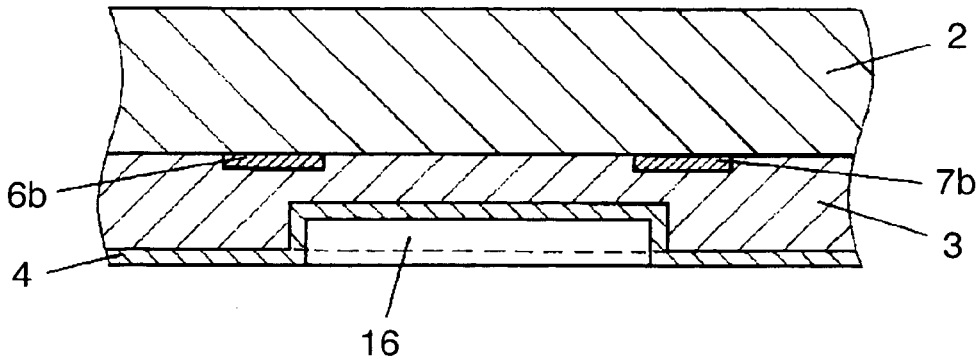

If scanning electrode 6 and sustain electrode 7 are constituted with only bus electrodes 6*b* and 7*b* as shown in FIGS. 15A and 15B, a cost for forming electrode 5 is reduced. Furthermore, because bus electrodes 6*b* and 7*b* are made of metallic material having better electrical conductivity than transparent electrodes 6*a* and 7*b*, an electric charge is easily accumulated in recess 16, thereby further ensuring a discharge area to be restricted within discharge cell 15.

Figure 16A:
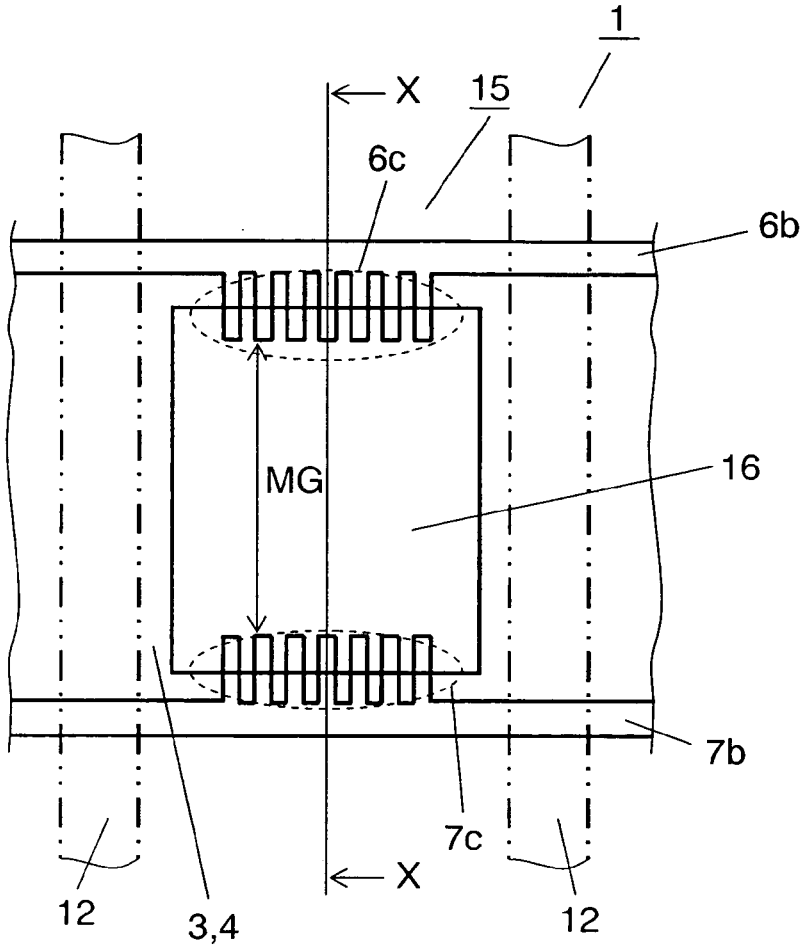
FIGS. 16A and 16B are partially magnified views of a discharge cell having other structure in the front panel of the PDP of the third exemplary embodiment.
Figure 16B:
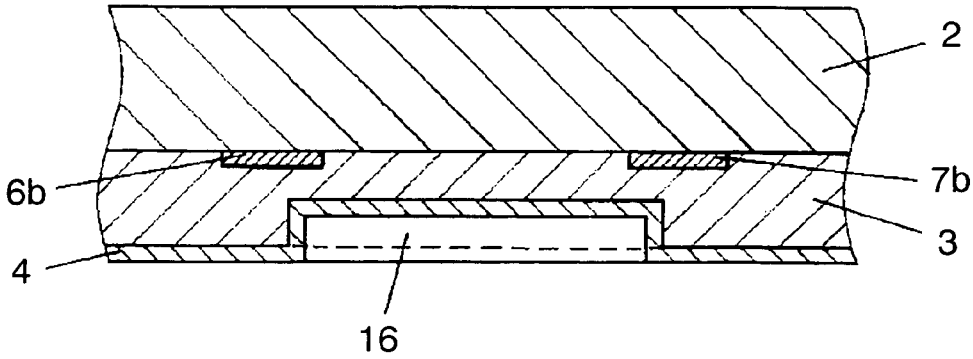
Figure 17A:
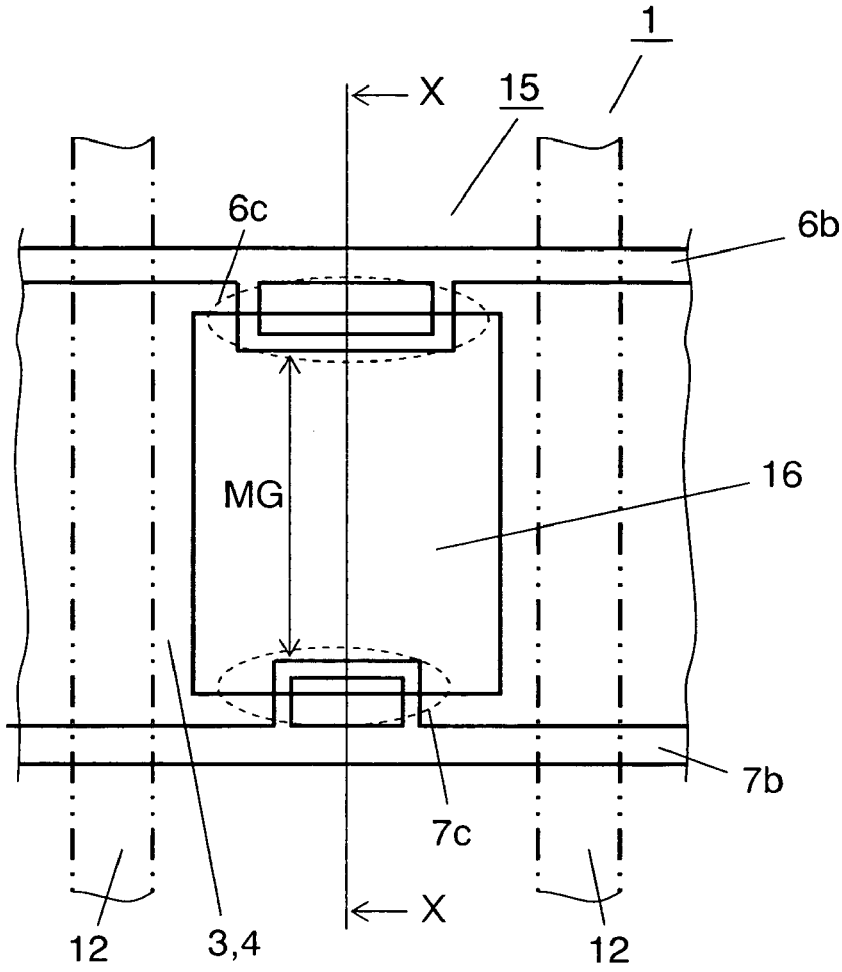
FIGS. 17A and 17B are partial magnified views of a discharge cell having other structure in the front panel of the PDP of the third exemplary embodiment.
Figure 17B:
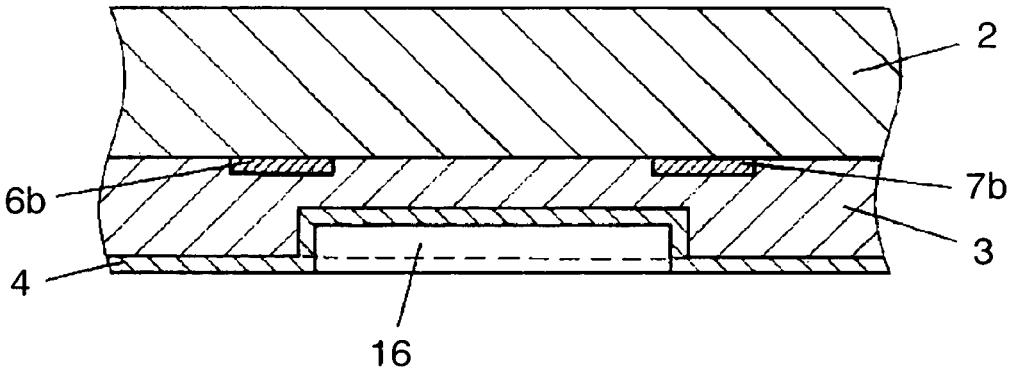

Protrusions 6*c* and 7*c* can be made into a comb-shape having multiples of forks as shown in FIG. 16A, or into a hollow shape as shown in FIG. 17A. With these structures, dimensions of protrusions 6*c* and 7*c* are reduced without distance of discharge gap MG being changed, whereby a transparency for the luminescence from phosphor layer 13 is compensated. Because a dimension of an electrode is reduced, a discharge current is reduced and power consumption is reduced.

Figure 18A:
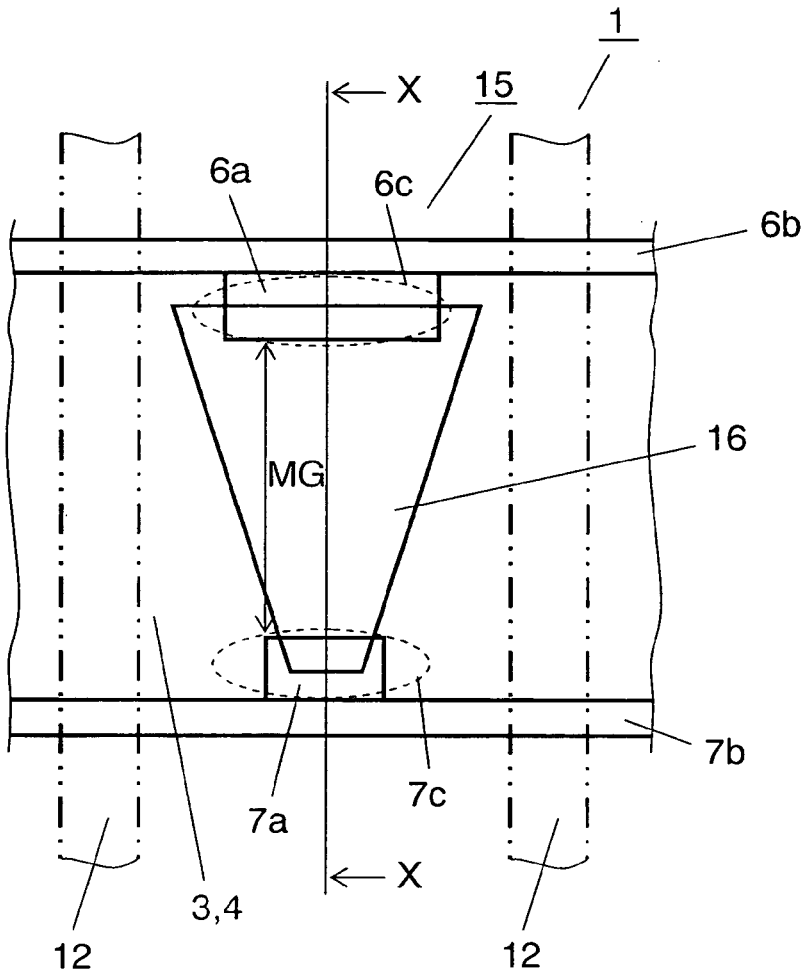
FIGS. 18A and 18B are partially magnified views of a discharge cell having other structure in the front panel of the PDP of the third exemplary embodiment.
Figure 18B:
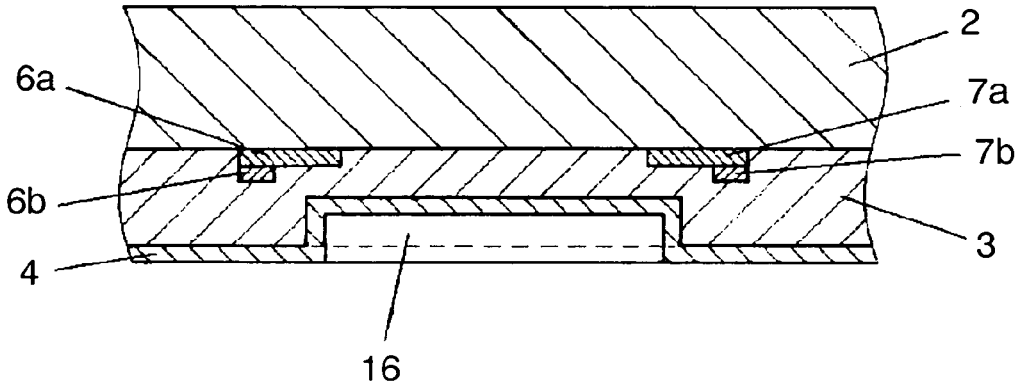
Figure 19A:
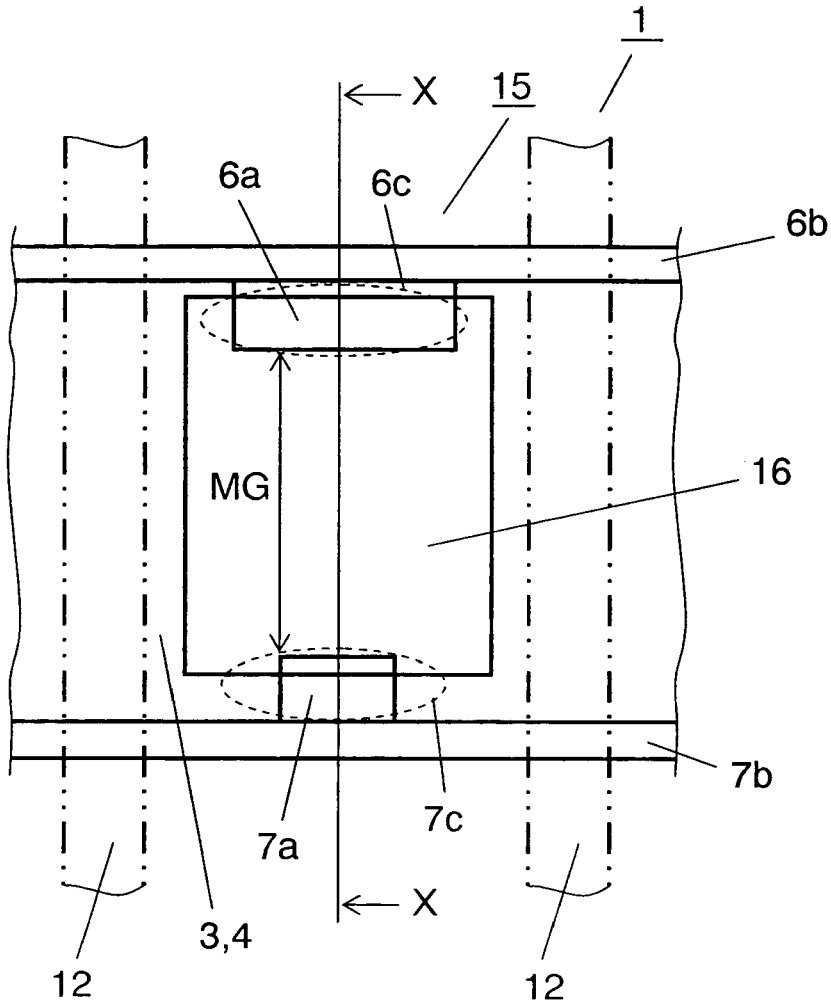
FIGS. 19A and 19B are partially magnified views of a discharge cell having other structure in the front panel of the PDP of the third exemplary embodiment.
Figure 19B:
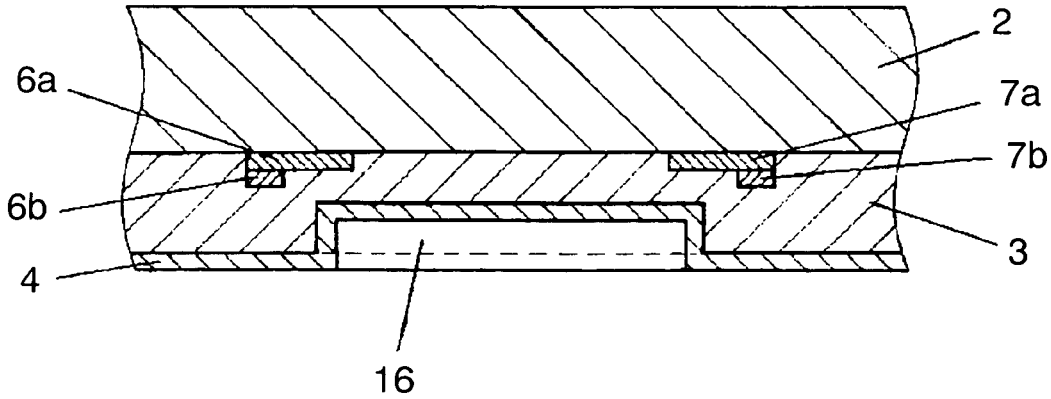
Figure 20A:
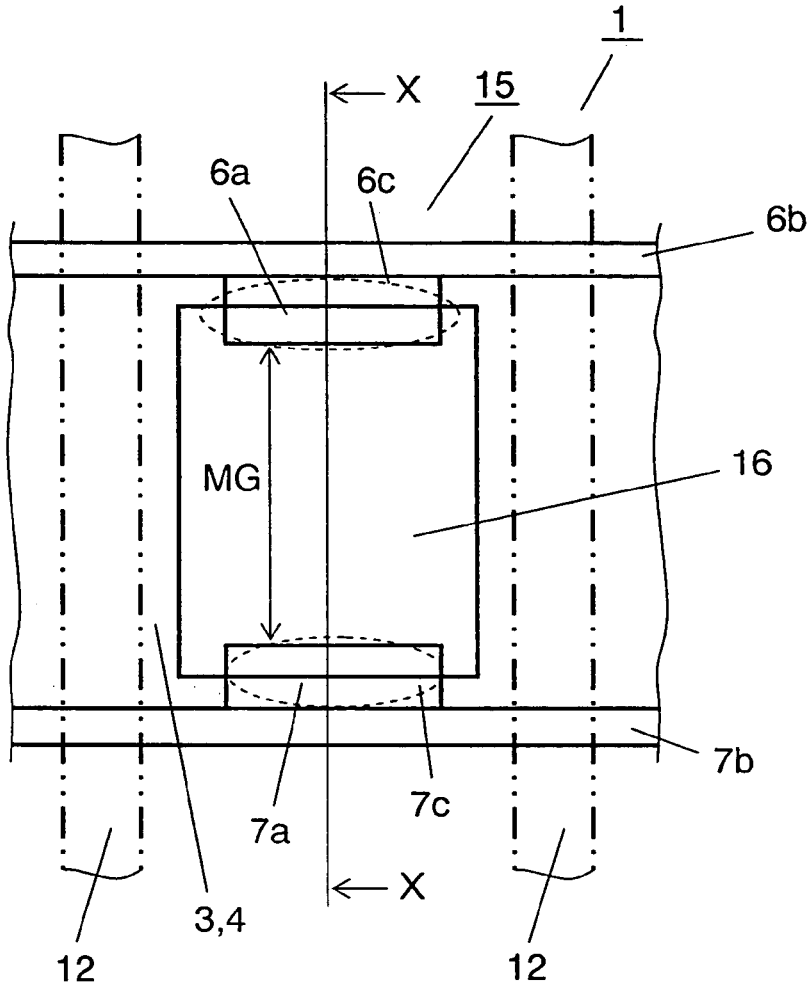
FIG. 20 is a partially magnified view of a discharge cell having other structure in the front panel of the PDP of the third exemplary embodiment.
Figure 20B:
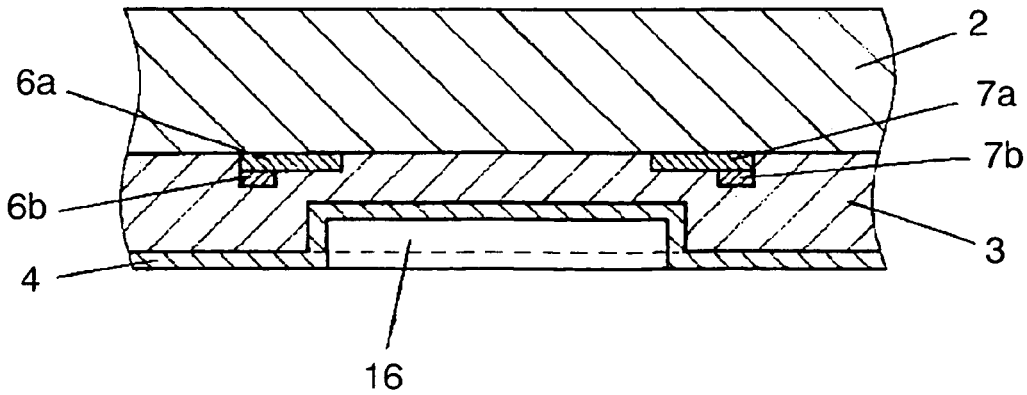

A shape of recess 16 can be made different between a side for scanning electrode 6 and a side for sustain electrode 7, in addition to dimensions of protrusions 6*c* and 7*c* being changed. Namely, a shape of recess 16 can be made larger at a side for scanning electrode 6 but narrower at a side of the sustain electrode 7 as shown in FIG. 18A, or recess 16 can be shifted toward scanning electrode 6 as shown in FIG. 19A. It is further preferable, by constituting a cell like in these instances, to make a dimension where recess 16 overlaps scanning electrode 6 larger than a dimension where recess 16 overlaps sustain electrode 7.

With other structure it is possible to make protrusion 6*c* larger than protrusion 7*c* by increasing an amount of protrusion 6*c* while keeping a width of these protrusions identical to each other. With this structure, a similar effect is obtained.

For attaining high efficiency of a PDP, a method of increasing a partial pressure of Xe of a discharge gas is generally known. A mixed gas of Xe with Ne and/or He with a partial pressure of 5 to 30% of Xe is used for instance as the discharge gas. However, when the partial pressure of Xe is raised, a discharge voltage is resultantly increased, and radiation of ultraviolet rays is also increased, thereby easily saturating brightness. To overcome these problems, a film of dielectric layer 3 is made thicker in a conventional method for decreasing capacitance of dielectric layer 3, thereby decreasing an amount of an electric charge generated per pulse. However, as the thickness of dielectric layer 3 is increased, a transparency ratio of dielectric layer 3 is decreased, thereby falling out of this efficiency. When the thickness of dielectric layer 3 is increased, a problem occurs in that the discharge voltage increases.

In the present invention, however, by properly selecting a shape and a size of recess 16 and of display electrode 5, a discharge area is restricted and a discharge current is voluntarily controlled, thereby saturation of brightness caused by a high partial pressure of Xe is controlled. Namely, with the present invention, a discharge current necessary for the PDP with the high partial pressure of Xe is controlled only by a dielectric material without changing a circuit or a driving method.

INDUSTRIAL APPLICABILITY

The present invention provides a plasma display panel preventing a false discharge to occur between adjacent discharge cells even for a high precision type, and securely generating an address discharge between a scanning electrode and a data electrode, thereby displaying a quality display picture.

The invention claimed is:

1. A plasma display panel comprising:

a front panel including display electrodes and a dielectric layer covering said display electrodes, each of said display electrodes composed of a scanning electrode and a sustain electrode; and a back panel including data electrodes extending orthogonally across said display electrodes, wherein said front panel and said back panel face one another such that a discharge cell is defined at each location that each of said data electrodes crosses said each of said display electrodes, and wherein, in each said discharge cell, said dielectric layer has a recess overlapping said scanning electrode and said sustain electrode of a corresponding one of said display electrodes, with a dimension of a portion of said recess that overlaps said scanning electrode being greater than a corresponding dimension of another portion of said recess that overlaps said sustain electrode.

2. The plasma display panel according to claim 1, wherein said dimension of said portion of said recess corresponds to a dimension extending in a widthwise direction of said data electrodes, and said corresponding dimension of said another portion of said recess corresponds to a dimension extending in the widthwise direction of said data electrodes.

3. The plasma display panel according to claim 2, wherein said scanning electrode comprises a transparent electrode and a metallic bus electrode, with said portion of said recess overlapping said transparent electrode and said metallic bus electrode, and said sustain electrode comprises a transparent electrode and a metallic bus electrode, with said another portion of said recess overlapping said transparent electrode but not said metallic bus electrode of said sustain electrode.

4. The plasma display panel according to claim 1, wherein said dimension of said portion of said recess corresponds to a dimension extending in a lengthwise direction of said data electrodes, and said corresponding dimension of said another portion of said recess corresponds to a dimension extending in the lengthwise direction of said data electrodes.

5. The plasma display panel according to claim 4, wherein said scanning electrode comprises a transparent electrode and a metallic bus electrode, with said portion of said recess overlapping said transparent electrode and said metallic bus electrode, and said sustain electrode comprises a transparent electrode and a metallic bus electrode, with said another portion of said recess overlapping said transparent electrode but not said metallic bus electrode of said sustain electrode.

6. The plasma display panel according to claim 1, wherein said scanning electrode comprises a first electrode and a first bus electrode, and said sustain electrode comprises a second electrode and a second bus electrode.

7. The plasma display panel according to claim 6, wherein said dimension of said portion of said recess corresponds to a dimension extending in a widthwise direction of said data electrodes, and said corresponding dimension of said another portion of said recess corresponds to a dimension extending in the widthwise direction of said data electrodes.

8. The plasma display panel according to claim 7, wherein said first electrode comprises a transparent first electrode, and said first bus electrode comprises a metallic first bus electrode, with said portion of said recess overlapping said transparent first electrode and said metallic first bus electrode, and said second electrode comprises a transparent second electrode, and said second bus electrode comprises a metallic second bus electrode, with said another portion of said recess overlapping said transparent second electrode but not said metallic second bus electrode.

9. The plasma display panel according to claim 6, wherein said dimension of said portion of said recess corresponds to a dimension extending in a lengthwise direction of said data electrodes, and said corresponding dimension of said another portion of said recess corresponds to a dimension extending in the lengthwise direction of said data electrodes.

10. The plasma display panel according to claim 9, wherein said first electrode comprises a transparent first electrode, and said first bus electrode comprises a metallic first bus electrode, with said portion of said recess overlapping said transparent first electrode and said metallic first bus electrode, and said second electrode comprises a transparent second electrode, and said second bus electrode comprises a metallic second bus electrode, with said another portion of said recess overlapping said transparent second electrode but not said metallic second bus electrode.

11. The plasma display panel according to claim 6, wherein said scanning electrode is spaced from said sustain electrode by a discharge gap.

12. The plasma display panel according to claim 11, wherein said dimension of said portion of said recess corresponds to a dimension extending in a widthwise direction of said data electrodes, and said corresponding dimension of said another portion of said recess corresponds to a dimension extending in the widthwise direction of said data electrodes.

13. The plasma display panel according to claim 12, wherein said first electrode comprises a transparent first electrode, and said first bus electrode comprises a metallic first bus electrode, with said portion of said recess overlapping said transparent first electrode and said metallic first bus electrode, and said second electrode comprises a transparent second electrode, and said second bus electrode comprises a metallic second bus electrode, with said another portion of said recess overlapping said transparent second electrode but not said metallic second bus electrode.

14. The plasma display panel according to claim 11, wherein said dimension of said portion of said recess corresponds to a dimension extending in a lengthwise direction of said data electrodes, and said corresponding dimension of said another portion of said recess corresponds to a dimension extending in the lengthwise direction of said data electrodes.

15. The plasma display panel according to claim 14, wherein said first electrode comprises a transparent first electrode, and said first bus electrode comprises a metallic first bus electrode, with said portion of said recess overlapping said transparent first electrode and said metallic first bus electrode, and said second electrode comprises a transparent second electrode, and said second bus electrode comprises a metallic second bus electrode, with said another portion of said recess overlapping said transparent second electrode but not said metallic second bus electrode.

16. The plasma display panel according to claim 11, wherein said dimension of a portion of said recess that overlaps said scanning electrode being greater than said corresponding dimension of another portion of said recess that overlaps said sustain electrode corresponds to an area of said portion of said recess being greater than an area of said another portion of said recess.

17. The plasma display panel according to claim 16, wherein said first electrode comprises a transparent first electrode, and said first bus electrode comprises a metallic first bus electrode, with said portion of said recess overlapping said transparent first electrode and said metallic first bus electrode, and said second electrode comprises a transparent second electrode, and said second bus electrode comprises a metallic second bus electrode, with said another portion of said recess overlapping said transparent second electrode but not said metallic second bus electrode.

18. The plasma display panel according to claim 1, wherein said scanning electrode is spaced from said sustain electrode by a discharge gap.

19. The plasma display panel according to claim 18, wherein said dimension of said portion of said recess corresponds to a dimension extending in a widthwise direction of said data electrodes, and said corresponding dimension of said another portion of said recess corresponds to a dimension extending in the widthwise direction of said data electrodes.

20. The plasma display panel according to claim 19, wherein said scanning electrode comprises a transparent electrode and a metallic bus electrode, with said portion of said recess overlapping said transparent electrode and said metallic bus electrode, and said sustain electrode comprises a transparent electrode and a metallic bus electrode, with said another portion of said recess overlapping said transparent electrode but not said metallic bus electrode of said sustain electrode.

21. The plasma display panel according to claim 18, wherein said dimension of said portion of said recess corresponds to a dimension extending in a lengthwise direction of said data electrodes, and said corresponding dimension of said another portion of said recess corresponds to a dimension extending in the lengthwise direction of said data electrodes.

22. The plasma display panel according to claim 21, wherein said scanning electrode comprises a transparent electrode and a metallic bus electrode, with said portion of said recess overlapping said transparent electrode and said metallic bus electrode, and said sustain electrode comprises a transparent electrode and a metallic bus electrode, with said another portion of said recess overlapping said transparent electrode but not said metallic bus electrode of said sustain electrode.

* * * * *